US006565674B1

(12) United States Patent
Kurosaki et al.

(10) Patent No.: US 6,565,674 B1
(45) Date of Patent: May 20, 2003

(54) HIGH FLUX DENSITY GRAIN-ORIENTED ELECTRICAL STEEL SHEET EXCELLENT IN HIGH MAGNETIC FIELD CORE LOSS PROPERTY AND METHOD OF PRODUCING THE SAME

(75) Inventors: Yousuke Kurosaki, Himeji (JP); Masahiro Fujikura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/580,888

(22) Filed: May 30, 2000

(30) Foreign Application Priority Data

May 31, 1999 (JP) ..... 11-152341
May 31, 1999 (JP) ..... 11-152342

(51) Int. Cl.[7] ..... H01F 1/04; H01F 1/14; H01F 1/16; H01F 1/18

(52) U.S. Cl. ..... 148/308; 420/117; 148/111

(58) Field of Search ..... 148/307, 308, 148/110–113; 420/117

(56) References Cited

U.S. PATENT DOCUMENTS 4,645,547 A * 2/1987 Krause ..... 148/111
4,960,652 A * 10/1990 Wada et al. ..... 428/611
5,067,992 A * 11/1991 Pavlik et al. ..... 148/307
5,350,464 A * 9/1994 Benford ..... 148/308
5,702,541 A * 12/1997 Inkuti ..... 148/308
5,718,775 A * 2/1998 Komatsubara et al. ..... 148/308
6,287,703 B1 * 9/2001 Inokuti ..... 428/472

OTHER PUBLICATIONS

IEEE Transactions on Magnetics, vol. Mag–14, No. 4, Jul. 1978 (pp. 252–257).

* cited by examiner

*Primary Examiner*—John P. Sheehan
(74) *Attorney, Agent, or Firm*—Kenyon & Kenyon

(57) ABSTRACT

A high flux density grain-oriented electrical steel sheet excellent in high magnetic field core loss property containing, in percentage by weight, not greater than 0.005% of C, 2.0–7.0% of Si, not greater than 0.2% of Mn, one or both of S and Se in a total amount of not greater than 0.005%, the balance being of Fe and unavoidable impurities, optionally containing, in percentage by weight, of not greater than 0.065% of Al, not greater than 0.005% of N and 0.003–0.3% each of one or more of Sb, Sn, Cu, Mo, Ge, B, Te, As, Cr and Bi, the steel sheet having a grain orientation deviating from an ideal {110}<001> orientation by an average of not greater than 5°, having an average 180° magnetic domain width of not greater than 0.30 mm, preferably not greater than 0.26 mm or greater than 0.26 mm and not greater than 0.30 mm, and having an area ratio of magnetic domains of a width greater than 0.4 mm of greater than 3% and not greater than 20%.

6 Claims, 4 Drawing Sheets

HIGH FLUX DENSITY GRAIN-ORIENTED ELECTRICAL STEEL SHEET EXCELLENT IN HIGH MAGNETIC FIELD CORE LOSS PROPERTY AND METHOD OF PRODUCING THE SAME

BACKGROUND OF THE INVENTION

1. Field of the Invention

The present invention relates to a grain-oriented electrical steel sheet for use in the cores of transformers and the like and to a method of producing the same.

2. Description of the Related Art

Grain-oriented electrical steel sheet is used primarily as a core material for transformers and generators. The steel sheet has low core loss achieved by utilizing secondary recrystallization during finish annealing in the production process to confer a texture with high-density {110}<001> orientation (Goss orientation). JIS C 2553 classifies the core loss of grain-oriented electrical steel sheet into different grades based on $W_{17/50}$ (energy loss under excitation conditions of B8 1.7 T, 5.0 Hz).

Transformer cores are of two types, wound and stacked. In order to realize a compact transformer, a designed flux density of higher than 1.7 T, e.g., around 1.9 T, may be used in either type.

Since the stacked core is fabricated by stacking steel sheets like the floors of a building, the flux density may locally become greater than 1.7 T even though the designed flux density is 1.7 T. At higher than 1.7 T, e.g., at $W_{19/50}$, the transformer core loss is strongly affected.

Increasing awareness of the need for global environmental protection and energy conservation has recently generated demand for grain-oriented electrical steel sheet with still lower core loss, particularly for a steel sheet with low core loss even in a high-intensity magnetic field of, say, 1.9 T. Over many years, there has been seen little or no innovation or improvement aimed at lowering $W_{17/50}$ core loss to meet this demand.

SUMMARY OF THE INVENTION

In light of the foregoing circumstances, the present invention has as its object to provide a high flux density grain-oriented electrical steel sheet low in core loss at excitation flux densities higher than 1.7 T.

The gist of the present invention for overcoming the foregoing issues is as follows.

The present invention provides a high flux density grain-oriented electrical steel sheet excellent in high magnetic field core loss property containing, in percentage by weight, not greater than 0.005% of C, 2.0–7.0% of Si, not greater than 0.2% of Mn, one or both of S and Se in a total amount of not greater than 0.005%, the balance being of Fe and unavoidable impurities, optionally containing, in percentage by weight, not greater than 0.065% of Al, not greater than 0.005% of N and 0.003–0.3% each of one or more of Sb, Sn, Cu, Mo, Ge, B, Te, As, Cr and Bi, the steel sheet having a grain orientation deviating from an ideal {110}<001> orientation by an average of not greater than 5°, having an average 180° magnetic domain width of not greater than 0.30 mm preferably not greater than 0.26 mm or greater than 0.26 mm and not greater than 0.30 mm, and having an area ratio of magnetic domains of a width greater than 0.4 mm of greater than 3% and not greater than 20%.

The method of producing a high flux density grain-oriented electrical steel sheet excellent in high magnetic field core loss property according the present invention comprises a step of making a steel containing, in percentage by weight, 0.015% to not greater than 0.100% of C, 2.0–7.0% of Si, 0.03–0.2% of Mn, one or both of S and Se in a total amount of 0.005–0.050%, optionally containing, in percentage by weight, not greater than 0.065% of Al, not greater than 0.005% of N and 0.003–0.3% each of one or more of Sb, Sn, Cu, Mo, Ge, B, Te, As, Cr and Bi, the balance being Fe and unavoidable impurities, a step of obtaining a starting material by heating and then hot rolling a slab of the steel into a coiled steel sheet or by directly casting a coiled steel sheet from the molten steel, a step of obtaining a steel sheet of final thickness by hot-rolled coil annealing and strong cold rolling, by preliminary cold rolling, precipitation annealing and strong cold rolling, or by hot rolled coil annealing, preliminary cold rolling, precipitation annealing and heavy cold rolling, and a step of subjecting the steel sheet of a final thickness to decarburization annealing, final finish annealing and final coating, which method further comprises a step of rapid heating to a temperature of 800° C. or higher at a heating speed of not less than 100° C./s immediately prior to the decarburization annealing and a step of effecting magnetic domain control during or at the end of the production process, thereby providing a steel sheet having a grain orientation deviating from an ideal {110}<001> orientation by an average of not greater than 5°, having an average 180° magnetic domain width of not greater than 0.30 mm, preferably not greater than 0.26 mm or greater than 0.26 mm and not greater than 0.30 mm, and having an area ratio of magnetic domains of a width greater than 0.4 mm of greater than 3% and not greater than 20%.

BRIEF DESCRIPTION OF THE DRAWINGS

FIG. 2(*b*) is a diagram showing the distribution of 180° magnetic domain widths in a sample (2) produced according to the present invention.

FIG. 2(*c*) is a diagram showing the distribution of 180° magnetic domain widths in a sample (3) produced according to the present invention.

DESCRIPTION OF THE PREFERRED EMBODIMENTS

The present invention will now be explained in detail.

The inventors conducted an intensive study aimed at developing a grain-oriented electrical steel sheet low in ($W_{19/50}$). As a result, they discovered that strict control of grain orientation deviation angle and 180° magnetic domain width is highly effective for this purpose.

The inventors produced high flux density grain-oriented electrical steel sheet under variously modified production process conditions to obtain products high and low in $W_{19/50}$. A 0.23-mm thick steel sheet containing, in percentage by weight, 0.002% of C, 3.25% of Si, 0.07% of Mn, 0.001% of S, 0.01% of Al, 0.001% of T. N, 0.11% of Sn and 0.07% of Cu, and having a composition within the range of the present invention was produced and samples whose grain orientation deviated from {110}<001> orientation by an average of 3% were examined, with the following results.

Figure 2A:
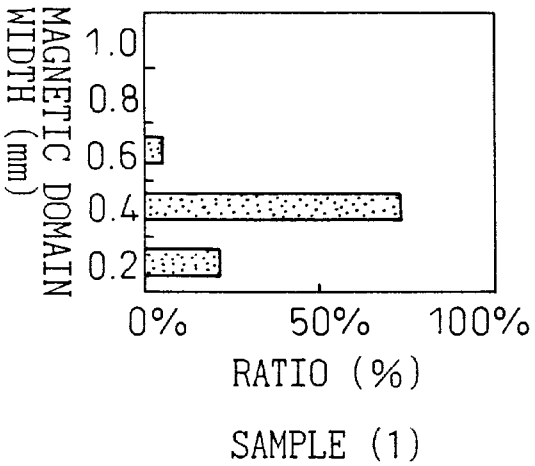
FIG. 2(*a*) is a diagram showing the distribution of 180° magnetic domain widths in a sample (1) produced according to the present invention.
Figure 2B:
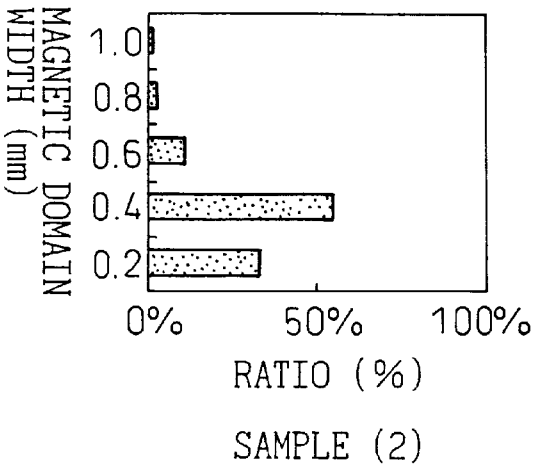
Figure 2C:
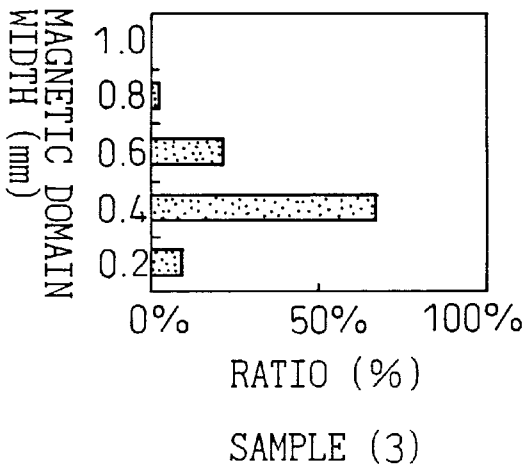

As shown in FIGS. 2(*a*), 2(*b*) and 2(*c*), sample (1) exhibited $W_{17/50}$ of 0.70 W/kg and $W_{19/50}$ of 1.20 W/kg, sample (2) exhibited $W_{17/50}$ of 0.77 W/kg and $W_{19/50}$ of 1.35 W/kg, and sample (3) exhibited $W_{17/50}$ of 0.77 W/kg and $W_{19/50}$ of 1.49 W/kg. What is noteworthy here is that samples (2) and (3) differed in $W_{19/50}$ despite being the same in $W_{17/50}$.

In their search for the cause of this difference in core loss, the inventors focused on the 180° magnetic domain width. Core loss is generally classified into hysteresis loss, classical eddy current loss and abnormal eddy current loss. Abnormal eddy current loss accounts for about 40% of total core loss. It is known that in the case of a grain-oriented electrical steel sheet, abnormal eddy current loss increases in proportion to 180° magnetic domain width.

T. Nozawa et al. reported having quantified the relationship between grain orientation and 180° magnetic domain width in single crystal (IEEE Trans. Mag. No.4, MAG-14 (1978), p.252).

However, quantification of 180° magnetic domain width in a grain-oriented electrical steel sheet product, a polycrystal, has not been reported. Although it is well known that the 180° magnetic domain width of a steel sheet can be reduced by grooving, such as by imparting scratches, exposure to a laser beam or machining with a toothed roll, quantitative evaluation of the relationship between these treatments and 180° magnetic domain width has not been reported.

Figure 1:
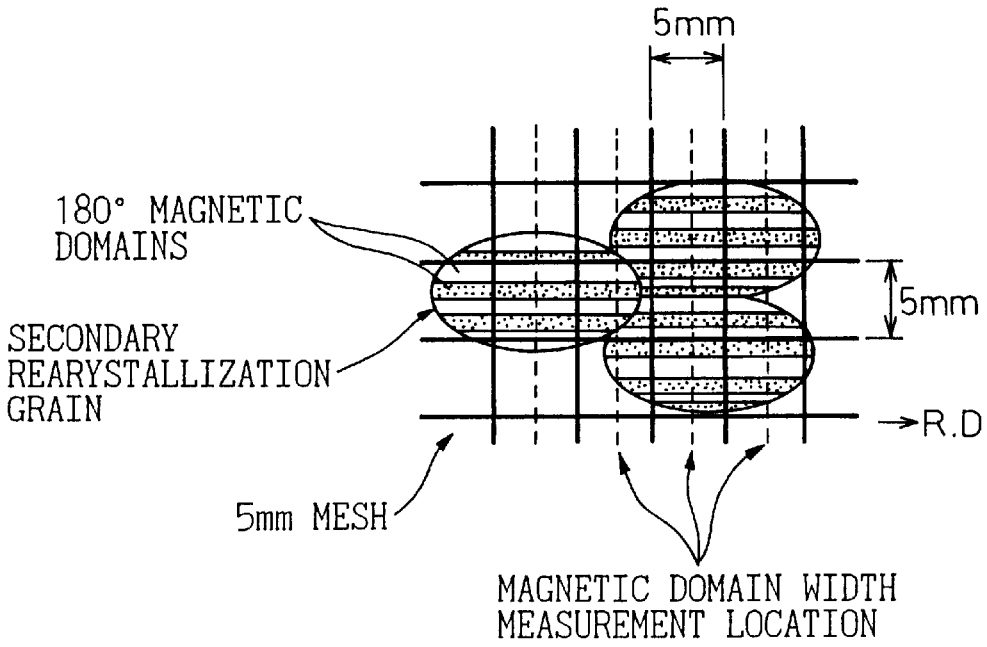
FIG. 1 is a diagram illustrating a method of measuring 180° magnetic domain width.

The inventors therefore devised the following method for quantifying the 180° magnetic domain width of high flux density grain-oriented electrical steel sheet, which is polycrystalline. The method is illustrated in FIG. 1.

First, the 180° magnetic domains of a steel sheet sample were visualized by Bitter's method. The sample was then overlaid with a 5 mm-mesh net and the number of 180° magnetic domains in each mesh was counted. With respect to each sample, the number of domains in 190 meshes was counted and the calculated magnetic domain width average and distribution of the 190 meshes were defined as the measured values of the sample. A total of about 2,000 180° magnetic domains were counted in each sample and this value was used to quantify the 180° magnetic domain width.

Magnetic domain width of single mesh=5 mm/number of 180° magnetic domains

Average magnetic domain width of sample=Average magnetic domain width of 190 meshes Area ratio of magnetic domains of width greater than 0.4 mm=Number of meshes with magnetic domain width greater than 0.4 mm/190 meshes This method was used to compare the 180° magnetic domain widths of sample (1) of FIG. 2(*a*) and sample (3) of FIG. 2(*c*). FIGS. 2(*a*)and 2(*c*) show the magnetic domain width distributions of samples (1) and (3). The magnetic domain widths indicated on the vertical axes in FIGS. 2(*a*), 2(*b*) and 2(*c*) represent the upper limits of the respective ranges. For instance, 0.2 means 0 to 0.2 mm, 0.4 means 0.2–0.4 mm. The comparison showed the average magnetic domain width of sample (1) to be 0.26 mm and that of sample (3) to be 0.32 mm. The average 180° magnetic domain width was thus found to differ greatly between samples (1) and (3).

The same method was used to compare the 180° magnetic domain widths of sample (2) of FIG. 2(*b*) and sample (3) of FIG. 2(*c*). FIGS. 2(*b*) and 2(*c*) show the magnetic domain width distributions of samples (2) and (3). The comparison showed the average magnetic domain width of sample (2) to be 0.27 mm and that of sample (3) to be 0.32 mm. The area ratio of magnetic domains of a width greater than 0.4 mm was 13% in sample (2) and 24% in sample (3).

The average 180° magnetic domain width and the area ratio of domains of a width greater than 0.4 mm were thus found to differ greatly between samples (2) and (3).

The results of tests conducted regarding the relationship between 180° magnetic domain width and each of $W_{17/50}$ and $W_{19/50}$ will now be discussed. 0.23-mm thick products containing, in percentage by weight, 0.002% of C, 3.25% of Si, 0.07% of Mn, 0.001% of S, 0.01% of Al, 0.001% of T. N, 0.11% of Sn and 0.07% of Cu were produced by various production methods and tested for average 180° magnetic domain width and $W_{17}/_{50}$ and $w_{19/50}$ core loss. Average deviation angle from {110}<001> orientation was 3°.

Figure 3:
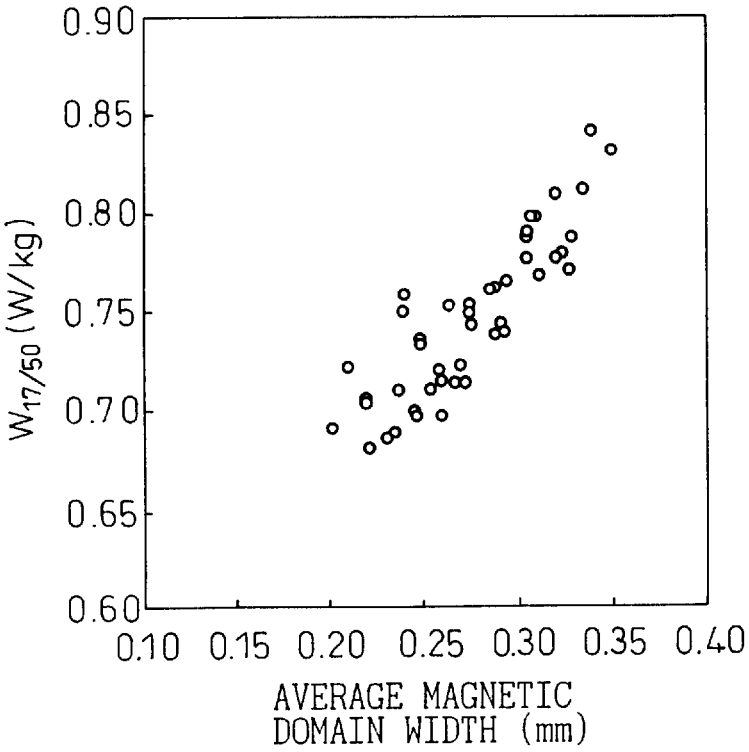
FIG. 3 is a graph showing how core loss ($W_{17/50}$) varied as a function of 180° magnetic domain width in different tested invention products.
Figure 4:
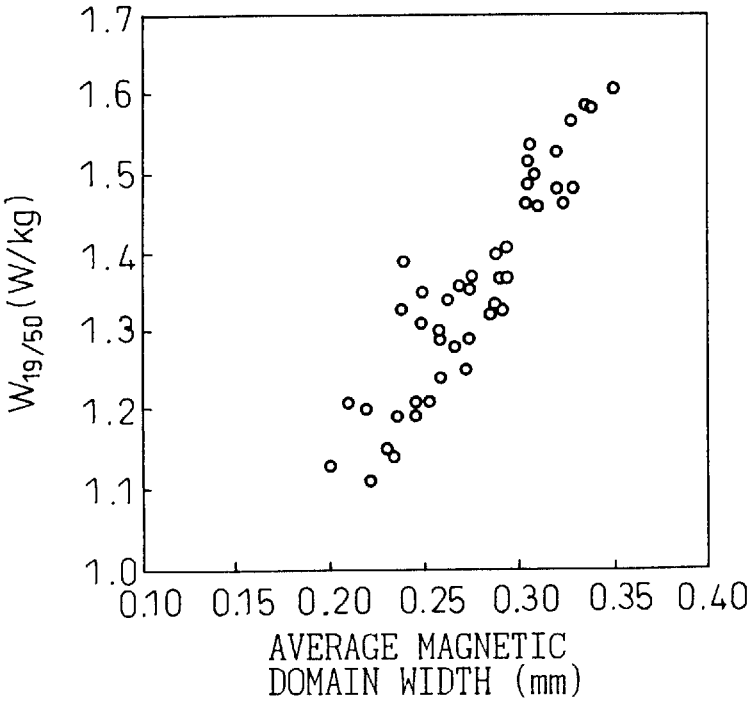
FIG. 4 is a graph showing how core loss ($W_{19/50}$) varied as a function of 180° magnetic domain width in different tested invention products.
Figure 5:
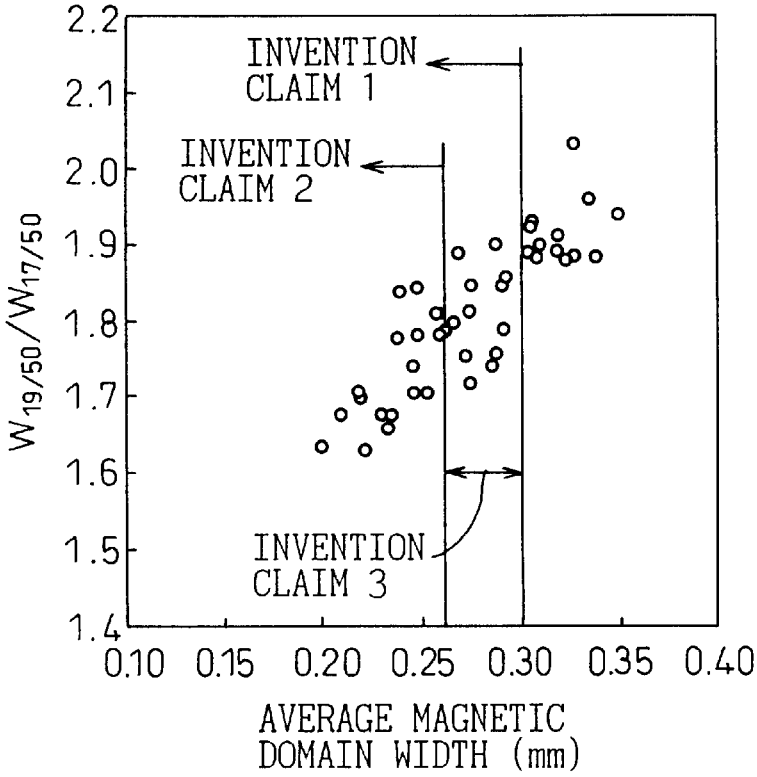
FIG. 5 is a graph showing how core loss $(W_{19/50})/(W_{17/50})$ varied as a function of 180° magnetic domain width in different tested invention products.

FIG. 3 shows how $W_{17/50}$ varied as a function of average 180° magnetic domain width of the products produced by the different methods. FIG. 4 shows how $W_{19/50}$ varied as a function of average 180° magnetic domain width of the same products. FIG. 5 shows how $W_{19/50}/W_{17/50}$ varied as a function of average 180° magnetic domain width of the same products. $W_{19/50}/W_{17/50}$ is an index of $W_{19/50}$ inferiority relative to $W_{17/50}$.

The correlation between average 180° magnetic domain width and each of $W_{17/50}$ and $W_{19/50}$ was good. It will be noted that both $W_{17/50}$ and $W_{19/50}$ decreased proportionally with narrower average 180° magnetic domain width. $W_{19/50}/W_{17/50}$ also decreased in proportion to narrowing of the average 180° magnetic domain width. It was thus found that particularly high magnetic field core loss property improves with a narrower average 180° magnetic domain width.

0.23-mm thick products containing, in percentage by weight, 0.002% of C, 3.25% of Si, 0.07% of Mn, 0.001% of S, 0.01% of Al, 0.001% of T. N, 0.11% of Sn and 0.07% of Cu were produced by various production methods and samples thereof having average 180° magnetic domain width of 0.25–0.26 mm were examined for relationship between average deviation angle from {110}<001> orientation and $W_{19/50}/W_{17/50}$.

Average deviation angle from {110}<001> orientation was measured by the Laue method and was expressed as the average deviation angle measured for 40 secondary recrystallization grains. By this it was found that a low $W_{19/50}/W_{17/50}$ is obtained at a deviation angle of 5° or less.

The reasons for the limitations defined regarding the invention high flux density grain-oriented electrical steel sheet excellent in high magnetic field core loss property will now be explained. All component contents set out in the following explanation are expressed in percentage by weight.

C (carbon) content is defined as not greater than 0.005% because the magnetic properties of the product deteriorate owing to magnetic aging when C is present in excess of 0.005%.

Si (silicon) content is defined as 2.0–7.0% because increased eddy current loss makes it impossible to obtain a good core loss property when Si is present at less than 2.0% and machinability is markedly degraded when Si is present in excess of 7.0%.

Mn (manganese) content is defined as not greater than 0.2%. The upper limit of 0.2% is set because Mn forms the inhibitors MnS and MnSe during the production process and remains in the steel after purification of S and Se by high-temperature annealing.

S (sulfur) and Se (selenium) content is defined as not greater than 0.005% in total. The upper limit of 0.005% is set because the selected S and/or Se forms the inhibitor MnS and/or the inhibitor MnSe and remains in the steel after purification of S and/or Se. A total content of S and Se in excess of 0.005% degrades core loss property.

Al (aluminum) content is defined as not greater 0.065%. The upper limit of 0.065% is set because Al forms the inhibitor AlN during the production process and remains in the steel after purification of N by high-temperature annealing. AlN need not be used as inhibitor.

N (nitrogen) content is defined as not greater than 0.005%. The upper limit of 0.005% is set because N forms AlN during the production process and remains in the steel after purification of N by high-temperature annealing. A content, in excess of 0.005% degrades core loss property. AlN need not be used as inhibitor.

One or more of Sb (antimony), Sn (tin), Cu (copper), Mo (molybdenum), Ge (germanium), B (boron), Te (tellurium), As (arsenic), Cr (chromium) and Bi (bismuth) can be selected for addition as necessary, each at a content of 0.003–0.3%, for the inhibition effect of their intergranular segregation.

Figure 6:
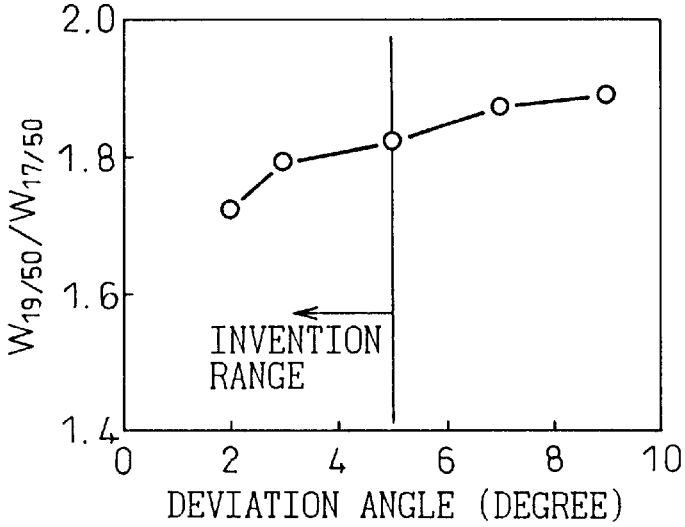
FIG. 6 is a graph showing how $(W_{19/50})/(W_{17/50})$ varied as a function of average deviation angle from {110}<001> orientation.

As can be seen from FIG. 5, high magnetic field core loss of the steel sheet can be markedly reduced by making its average 180° magnetic domain width not greater than 0.26 mm. As can be seen from FIG. 6, high magnetic field core loss cannot be reduced when the average angle of deviation of the steel sheet's grain orientation from the ideal {110}<001> orientation exceeds 5°.

The high flux density grain-oriented electrical steel sheet of the present invention is ordinarily provided on its surface with a primary coating, composed mainly of forsterite or spinel, and an insulation coating (secondary coating). Notwithstanding, no problems are encountered even if both the primary coating and the secondary coating are absent, only the primary coating is present, only the secondary coating is present and the primary coating is absent, or the insulation coating is a TiN coating or the like formed by ion plating or the like.

As can be seen from FIG. 5, high magnetic field core loss of the steel sheet can be reduced by making its average 180° magnetic domain width between 0.26 mm and 0.30 mm. The high magnetic field core loss can be reduced by making the area ratio of magnetic domains of the steel sheet having a width greater than 0.4 mm greater than 3% and not greater than 20%. Moreover, as can be seen from the Examples set out below; a high magnetic field core loss cannot be reduced when the average deviation angle of the steel sheet's grain orientation from the ideal {110}<001> orientation exceeds 5°.

The method of producing the high flux density grain-oriented electrical steel sheet excellent in high magnetic field core loss property will now be explained. The composition of the starting material, which is a hot-rolled coil or a coil directly cast from the molten steel, will be explained first.

C content is defined as having a lower limit of 0.015% because secondary recrystallization is unstable at a lower content. The upper limit of C content is set at 0.100% because at a higher content the time required for decarburization becomes so long as to be economically disadvantageous.

Si content is defined as 2.0–7.0% because good core loss property cannot be obtained at a content of less than 2% and cold rolling property is markedly inferior at a content in excess of 7%.

Mn content is defined as 0.03–0.2% because hot embrittlement occurs at a content of less than 0.03% and magnetic properties deteriorate rather than improve at a content in excess of 0.2%.

S and/or Se total content is defined as 0.005–0.050%. These elements are required for forming MnS and MnSe. When the total content of S and/or Se is less than the lower limit of 0.005%, the absolute amounts of MnS and Mn Se are insufficient. When it is greater than the upper limit of 0.050%, hot cracking occurs and purification during final finish annealing becomes difficult.

Sol. Al is a useful element for forming AlN. At a content of less than 0.010%, the absolute amount of AlN is insufficient and at a content of greater than 0.065%, an appropriately dispersed AlN state cannot be achieved. AlN need not be used as inhibitor.

N is a useful element for forming AlN. At a content of less than 0.0040%, the absolute amount of AlN is insufficient and at a content of greater than 0.0100%, an appropriately dispersed AlN state cannot be achieved. AlN need not be used as inhibitor.

Sb, Sn,. Cu, Mo, Ge, B, Te, As, Cr and Bi stabilize secondary recrystallization by the inhibitor effect of their intergranular segregation. The lower limit of the content of each element is set at 0.003% because the amount segregated is insufficient at a lower content. The upper limit is set at 0.3% in consideration of economy and to prevent degradation of decarburization property. These elements can be added individually or in combinations of two or more.

The steel melt can be cast into a slab or directly into a strip. When cast into a slab, it is finished into a steel sheet coil by an ordinary hot-rolling method. The strip or hot-rolled coil is processed to final sheet thickness by hot-rolled coil annealing and heavy cold rolling, by preliminary cold rolling, precipitation annealing and heavy cold rolling, or by hot rolled coil annealing, preliminary cold rolling, precipitation annealing and heavy cold rolling, and the steel sheet of final thickness is subjected to decarburization annealing, final finish annealing and final coating to obtain the product.

When the average 180° magnetic domain width is to be controlled to not greater than 0.26 mm, two additional steps are conducted. The first is a step of rapid heating to a temperature of 800° C. or higher at a heating speed of not less than 100° C./s immediately prior to the decarburization annealing. A low $W_{19/50}/W_{17/50}$ cannot be obtained at a heating speed lower than 100° C./s. A low $W_{19/50}/W_{17/50}$ is also impossible to obtain with heating to lower than 800° C. This rapid heating treatment can be incorporated in the heating stage, and this is preferable from the aspect of decreasing the number of steps.

The second is a step of effecting magnetic domain control of the product, i.e., of subjecting it to laser beam scanning, plasma exposure, toothed roll grooving, etching or the like. The magnetic domain control can, if desired, be conducted with respect to the steel sheet at an intermediate stage, such as with respect to the cold-rolled steel sheet, the decarburization annealed steel sheet, or the high-temperature annealed steel sheet.

Example 1

A 2.3 mm hot coil containing 0.071% of C, 3.22% of Si, 0.088% of Mn, 0.028% of S, 0.022% of Sol. Al, 0.0091% of N, 0.12% of Sn and 0.07% of Cu was obtained by continuously casting molten steel, slab heating and hot rolling. The hot coil was soaked at 1100° C.×10 s+950° C.×60 s, subjected to hot-rolled coil annealing with quenching, and strong cold rolled to the product thickness of 0.22 mm.

Each product was thereafter decarburization annealed in wet hydrogen at 850° C., coated with an annealing separation agent, held in a hydrogen stream at 1200° C. for 20 h to effect final finish annealing, and coated with a coating solution to obtain the final product.

Each steel sheet had grain orientation with an average deviation angle from {110}<001> orientation of 3° and a product steel composition including 0.002% of C, 3.18% of Si, 0.080% of Mn, 0.001% of S, 0.012% of Sol. Al, 0.0010% of N, 0.12% of Sn and 0.07% of Cu. The steel sheet was domain-controlled by scanning with a laser beam under conditions of a scan line interval of 6.5 mm, exposure point interval of 0.5 mm, and radiation energy of 1.0 mJ/mm$^2$.

Table 1 shows how the magnetic properties of the steel sheets varied with decarburization annealing heating speed. The invention examples can be seen to be superior to the comparative examples in high magnetic field core loss property.

TABLE 1

| Heating speed (° C./s) | Average 180° magnetic domain width (mm) | $W_{17/50}$ (W/kg) | $W_{19/50}$ (W/kg) | $W_{19/50}/W_{17/50}$ | Remark |
|---|---|---|---|---|---|
| 20 | 0.29 | 0.77 | 1.45 | 1.88 | Comparative example |
| 80 | 0.28 | 0.76 | 1.41 | 1.86 | Comparative example |
| 100 | 0.26 | 0.72 | 1.30 | 1.81 | Invention example |
| 300 | 0.22 | 0.68 | 1.15 | 1.69 | Invention example |

Example 2

A 2.0 mm hot coil containing 0.070% of C, 3.28% of Si, 0.078% of Mn, 0.024% of S, 0.021% of Sol. Al, 0.0089% of N, 0.1.2% of Sn and 0.07% of Cu was obtained by continuously casting molten steel, slab heating and hot rolling. The hot coil was soaked at 1100° C.×10 s+950° C.×60 s, subjected to hot-rolled sheet annealing with quenching, and strong cold rolled to the product thickness of 0.22 mm.

Thus obtained cold-rolled coil was thereafter decarburization annealed by effecting heating to different temperatures at a heating speed of 300° C./s.

The decarburization annealing is carried out in wet hydrogen at 850° C., coated with an annealing separation agent, held in a hydrbgen stream at 1200° C. for 20 h to effect final finish annealing, and coated with a coating solution to obtain the final product.

Each sheet had grain orientation with an average deviation angle from {110}<001> orientation of 3° and a product steel composition including 0.002% of C, 3.17% of Si, 0.070% of Mn, 0.001% of S, 0.009% of Sol. Al, 0.009% of N, 0.12% of Sn and 0.07% of Cu. The sheet was domain-controlled by scanning with a laser beam under conditions of a scan line interval of 6.5 mm, exposure point interval of 0.5 mm, and radiation energy of 1.0 mJ/mm$^2$. Table 2 shows how the magnetic properties of the sheets varied with the ultimate temperature in the heating stage. The invention examples can be seen to be superior to the comparative examples in high magnetic field core loss property.

TABLE 2

| Ultimate temperature (° C.) | Average 180° magnetic domain width (mm) | $W_{17/50}$ (W/kg) | $W_{19/50}$ (W/kg) | $W_{19/50}/W_{17/50}$ | Remark |
|---|---|---|---|---|---|
| 600 | 0.32 | 0.79 | 1.47 | 1.86 | Comparative example |
| 700 | 0.29 | 0.78 | 1.45 | 1.86 | Comparative example |
| 800 | 0.23 | 0.73 | 1.28 | 1.75 | Invention example |
| 850 | 0.21 | 0.68 | 1.14 | 1.68 | Invention example |

Example 3

A 2.3 mm coil containing 0.078% of C, 3.30% of Si, 0.078% of Mn, 0.022% of S, 0.032% of Sol. Al, 0.0078% of N, 0.15% of Sn and 0.07% of Cu was obtained by directly casting molten steel into a strip. The coiled strip was soaked at 1100° C.×10 s+950° C.×60 s, subjected to hot-rolled coil annealing with quenching, and heavy cold rolled to the product thickness of 0.22 mm.

When the obtained cold-rolled coil was thereafter decarburization annealed, heating to 850° C. was effected at 400° C./s in the heating stage. The result was thereafter decarburization annealed in wet hydrogen at 850° C., coated with an annealing separation agent, held in a hydrogen stream at 1200° C. for 20 h to effect final finish annealing, and coated with a coating solution to obtain the product.

The steel sheet had grain orientation with an average deviation angle from {110}<001> orientation of 3° and a product steel composition including 0.002% of C, 3.18% of Si, 0.070% of Mn, 0.001% of S, 0.012% of Sol. Al, 0.0010% of N, 0.15% of Sn and 0.07% of Cu. The average 180° magnetic domain width of some samples was altered by etch-grooving under conditions of groove interval of 5 mm, groove width of 150 μm, and a groove depth of 30 μm. The average 180° magnetic domain width, $W_{17/50}$, $W_{19/50}$ and $W_{19/50}/W_{17/50}$ of the resulting products are shown in Table 3. The invention example can be seen to be superior to the comparative example in high magnetic field core loss property.

TABLE 3

| Groove depth (μm) | Average 180° magnetic domain width (mm) | $W_{17/50}$ (W/kg) | $W_{19/50}$ (W/kg) | $W_{19/50}/W_{17/50}$ | Remark |
|---|---|---|---|---|---|
| None | 0.30 | 0.78 | 1.45 | 1.86 | Comparative example |
| 30 | 0.25 | 0.70 | 1.20 | 1.71 | Invention example |

Example 4

Hot coils of different thicknesses containing 0.078% of C, 3.30% of Si, 0.078%, of Mn, 0.022% of S, 0.032% of Sol. Al, 0.0078% of N, 0.15% of Sn and 0.07% of Cu were obtained by continuously casting molten steel, slab heating and hot rolling. The hot coils were soaked at 1100° C.×10 s+950° C.×60 s, subjected to hot-rolled coil annealing with quenching, and heavy cold rolled to the product thickness of 0.22 mm.

When the obtained cold-rolled coil were thereafter decarburization annealed, heating to 850° C. was effected at 400° C./s in the heating stage. The steel sheets were thereafter decarburization annealed in wet hydrogen at 850° C., coated with an annealing separation agent, held in a hydrogen stream at 1200° C. for 20 h to effect final finish annealing, and coated with a coating solution to obtain the products.

The steel of each product had a composition including 0.002% of C, 3.20% of Si, 0.068% of Mn, 0.001% of S, 0.011% of Sol. Al, 0.0010% of N, 0.15% of Sn and 0.07% of Cu. The steel sheet was domain-controlled by exposure to a laser beam under conditions of a scan line interval of 6.5 mm, exposure point interval of 0.5 mm, and radiation energy of 1.0 mJ/mm$^2$. The average 180° magnetic domain widths of the steel sheets were in the range of 0.23–0.26 mm.

The cold-rolling reduction ratio, average deviation angle from {110}<001> orientation, $W_{17/50}$, $W_{19/50}$ and $W_{19/50}/W_{17/50}$ of the steel sheets are shown in Table 4. The invention examples can be seen to be superior to the comparative examples in high magnetic field core loss property.

TABLE 4

| Cold rolling reduction ratio (%) | Deviation angle (degree) | $W_{17/50}$ (W/kg) | $W_{19/50}$ (W/kg) | $W_{19/50}/W_{17/50}$ | Remark |
|---|---|---|---|---|---|
| 81 | 8 | 0.80 | 1.52 | 1.90 | Comparative example |
| 83 | 6 | 0.79 | 1.49 | 1.89 | Comparative example |
| 85 | 4 | 0.74 | 1.32 | 1.78 | Invention example |
| 90 | 2 | 0.67 | 1.13 | 1.69 | Invention example |

Example 5

A slab containing 0.075% of C, 3.31% of Si, 0.075% of Mn, 0.014% of S, 0.014% of Se, 0.027% of Sol. Al, 0.0089% of N, 0.15% of Sb and 0.03% of Mo was obtained by continuously casting molten steel, slab heating and hot rolling. The slab was heated and hot rolled to obtain a 2.7 mm steel sheet. Hot-rolled sheet annealing was conducted at 1000° C. for 2 min, followed by cold rolling to 1.60 mm, precipitation annealing consisting of soaking at 1100° C. for 2 min followed by quenching, and final cold rolling to 0.22 mm.

When the obtained cold-rolled coil was thereafter decarburization annealed, different products were obtained by effecting heating to different temperatures at a heating speed of 300° C./s in the heating stage. Each product was thereafter decarburization annealed in wet hydrogen at 850° C., coated with an annealing separation agent, held in a hydrogen stream at 1200° C. for 20 h to effect final finish annealing, and coated with a coating solution to obtain the final product.

Each steel sheet had a grain orientation with an average deviation angle from {110}<001> orientation of 4° and a product steel composition including 0.003% of C, 3.23%,of Si, 0.065% of Mn, 0.001% of S, 0.001% of Se, 0.15% of Sb, and 0.03% of Mo. Some samples were subjected to domain control in the course of production by effecting etch-grooving of the cold-rolled coil under conditions of a groove interval of 3 mm, a groove width of. 150 μm and a groove depth of 20 μm. The magnetic properties of the steel sheets are shown in Table 5. The invention example can be seen to be superior to the comparative example in high magnetic field core loss property.

TABLE 5

| Groove depth (μm) | Average 180° magnetic domain width (mm) | $W_{17/50}$ (W/kg) | $W_{19/50}$ (W/kg) | $W_{19/50}/W_{17/50}$ | Remark |
|---|---|---|---|---|---|
| None | 0.30 | 0.81 | 1.54 | 1.90 | Comparative example |
| 20 | 0.25 | 0.74 | 1.36 | 1.84 | Invention example |

Example 6

A slab containing 0.065% of C, 3.33% of Si, 0.069% of Mn, 0.014% of S, 0.014% of Se, 0.15% of Sb and 0.03% of Mo was obtained by continuously casting molten steel, slab heating and hot rolling. The slab was heated and hot rolled to obtain a 2.2 mm steel sheet. Hot-rolled coil annealing was conducted at 1000° C. for 2 min, followed by cold rolling to 1.23 mm, precipitation annealing consisting of soaking at 1100° C. for 2 min followed by quenching, and final cold rolling to 0.19 mm.

When the obtained cold-rolled coil was thereafter decarburization annealed, different products were obtained by effecting heating to different temperatures at a heating speed of 300° C./s in the heating stage. Each product was thereafter decarburization annealed in wet hydrogen at 850° C., coated with an annealing separation agent, held in a hydrogen stream at 1200° C. for 20 h to effect final finish annealing, and coated with a coating solution to obtain the final product.

Each steel sheet had grain orientation with an average deviation angle from {110}<001> orientation of 4° and a product steel composition including 0.003% of C, 3.21% of Si, 0.070% of Mn, 0.001% of S, 0.001% of Se, 0.010% of Sol. Al, 0.0015% of N, 0.15% of Sb and 0.03% of Mo.

Some samples were subjected to domain control in the course of production by effecting etch-grooving of the cold-rolled coil under conditions of a groove interval of 3 mm, a groove width of 150 μm and a groove depth of 20 μm. The magnetic properties of the steel sheets are shown in Table 6. The invention example can be seen to be superior to the comparative example in high magnetic field core loss property.

TABLE 6

| Groove depth (μm) | Average 180° magnetic domain width (mm) | $W_{17/50}$ (W/kg) | $W_{19/50}$ (W/kg) | $W_{19/50}/W_{17/50}$ | Remark |
|---|---|---|---|---|---|
| None | 0.30 | 0.77 | 1.45 | 1.88 | Comparative example |
| 20 | 0.25 | 0.70 | 1.28 | 1.83 | Invention example |

Example 7

A high flux density grain-oriented electrical steel sheet product was produced by an ordinary method. The product composition included 0.002% of C, 3.26% of Si, 0.06% of Mn, 0.001% of S, 0.01% of Al, 0.001% of T. N, 0.12% of Sn and 0.07% of Cu. The product had a thickness of 0.23 mm and an average deviation angle from {110}<001> orientation of 3°. The result was scanned with a laser beam to alter the average 180° magnetic domain width.

The laser beam scanning was conducted under conditions of a scan line interval of 6.5 mm, exposure point interval of 0.5 mm, and radiation energy of 0–2.0 mJ/mm$^2$. The average 180° magnetic domain width, area ratio of magnetic domains of a width greater than 0.4 mm, $W_{17/50}$, $W_{19/50}$ and $W_{19/50}/W_{17/50}$ of the steel sheets are shown in Table 7. The invention examples can be seen to be superior in high magnetic field core loss property.

TABLE 7

| Laser beam energy (mJ/mm$^2$) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 0 | 0.34 | 27.0 | 0.85 | 1.66 | 1.95 | Comparative example |
| 0.4 | 0.32 | 24.2 | 0.79 | 1.51 | 1.91 | Comparative example |
| 0.6 | 0.29 | 19.1 | 0.77 | 1.38 | 1.79 | Invention example |
| 2.0 | 0.27 | 5.3 | 0.75 | 1.29 | 1.72 | Invention example |

Example 8

A high flux density grain-oriented electrical steel sheet product was produced by an ordinary method. The product composition included 0.002% of C, 3.25% of Si, 0.06% of Mn, 0.001% of S, 0.01% of Al, 0.001% of T. N, 0.11% of Sn and 0.06% of Cu. The product had a thickness of 0.23 mm and an average deviation.angle from {110}<001> orientation of 3°. The result was grooved with a toothed roll to alter the average 180° magnetic domain width.

The grooving was conducted under conditions of a groove interval of 5 mm, a groove width of 100 μm and a groove depth of 0–15 μm. The average 180° magnetic domain width, area ratio of magnetic domains of a width greater than 0.4 mm, $W_{17/50}$, $W_{19/50}$ and $W_{19/50}/W_{17/50}$ of the steel sheets are shown in Table 8. The invention examples can be seen to be superior in high magnetic field core loss property.

TABLE 8

| Groove depth (μm) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 0 | 0.35 | 35.3 | 0.84 | 1.65 | 1.96 | Comparative example |
| 5 | 0.33 | 26.6 | 0.79 | 1.52 | 1.92 | Comparative example |
| 12 | 0.29 | 19.1 | 0.77 | 1.39 | 1.81 | Invention example |
| 15 | 0.28 | 15.8 | 0.75 | 1.30 | 1.73 | Invention example |

Example 9

A high flux density grain-oriented electrical steel sheet product was produced by an ordinary method. The product composition included 0.002% of C, 3.27% of Si, 0.08% of Mn, 0.001% of S, 0.01% of Al, 0.001% of T. N, 0.13% of Sn and 0.07% of Cu. The product had a thickness of 0.23 mm and an average deviation angle from {110}<001> orientation of 3°. The result was etch-grooved to alter the average 180° magnetic domain width.

The grooving was conducted under conditions of a groove interval of 5 mm, a groove width of 150 μm and a groove depth of 0–40 μm. The average 180° magnetic domain width, area ratio of magnetic domains of a width greater than 0.4 mm, $W_{17/50}$, $W_{19/50}$ and $W_{19/50}/W_{17/50}$ of the steel sheets are shown in Table 9. The invention examples can be seen to be superior in high magnetic field core loss property.

TABLE 9

| Groove depth (μm) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 0 | 0.35 | 34.9 | 0.82 | 1.58 | 1.93 | Comparative example |
| 6 | 0.33 | 27.5 | 0.78 | 1.49 | 1.91 | Comparative example |
| 20 | 0.30 | 12.6 | 0.76 | 1.34 | 1.76 | Invention example |
| 40 | 0.27 | 4.7 | 0.73 | 1.26 | 1.73 | Invention example |

Example 10

A high flux density grain-oriented electrical steel sheet product was produced by an ordinary method. The product composition included 0.002% of C, 3.26% of Si, 0.06% of Mn, 0.001% of S, 0.001% of Se, 0.01.% of Al, 0.001% of T. N, 0.07% of Sb and 0.07% of Mo. The product had a thickness of 0.23 mm and an average deviation angle from {110}<001> orientation of 4°. Portions thereof were subjected to etch-grooving of the intermediate-stage cold-rolled steel sheet-under different conditions to alter the average 180° magnetic domain width.

The grooving was conducted under conditions of a groove interval of 3 mm, a groove width of 150 μm and a groove depth of 0–40 μm. The average 180° magnetic domain width, area ratio of magnetic domains of a width greater than 0.4 mm, $W_{17/50}$, $W_{19/50}$ and $W_{19/50}/W_{17/50}$ of the steel sheets are shown in Table 10. The invention examples can be seen to be superior in high magnetic field core loss property.

TABLE 10

| Groove depth (μm) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 0 | 0.37 | 41.4 | 0.88 | 1.74 | 1.98 | Comparative example |
| 10 | 0.33 | 28.3 | 0.80 | 1.56 | 1.95 | Comparative example |
| 20 | 0.29 | 17.8 | 0.79 | 1.49 | 1.89 | Invention example |
| 40 | 0.27 | 3.1 | 0.76 | 1.41 | 1.86 | Invention example |

Example 11

A high flux density grain-oriented electrical steel sheet product was produced by an ordinary method. The product composition included 0.002% of C, 3.28% of Si, 0.06% of Mn, 0.001% of S, 0.01% of Al, 0.001% of T. N, 0.12% of Sn and 0.07% of Cu. The product had a thickness of 0.23 mm and an average deviation angle from {110}<001> orientation of 3°. The tension of the product insulation coating was varied to alter the average 180° magnetic domain width.

The average 180° magnetic domain width, area ratio of magnetic domains of a width greater than 0.4 mm, $W_{17/50}$, $W_{19/50}$ and $W_{19/50}/W_{17/50}$ of the steel sheets are shown in Table 11. The invention examples can be seen to be superior in high magnetic field core loss property.

TABLE 11

| Insulation coating tension (gf/mm$^2$) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 800 | 0.35 | 37.2 | 0.83 | 1.61 | 1.94 | Comparative example |
| 1000 | 0.31 | 22.6 | 0.81 | 1.55 | 1.91 | Comparative example |
| 1200 | 0.28 | 9.1 | 0.79 | 1.47 | 1.86 | Invention example |
| 1400 | 0.27 | 3.1 | 0.76 | 1.37 | 1.80 | Invention example |

Example 12

A high flux density grain-oriented electrical steel sheet product was produced by an ordinary method. The final cold-rolling reduction ratio was varied. The products had a composition including 0.002% of C, 3.22% of Si, 0.06% of Mn, 0.001% of S, 0.01% of Al, 0.001% of T. N, 0.12% of Sn and 0.07% of Cu. The products had a thickness of 0.23 mm and an average 180° magnetic domain width of 0.28–0.29 mm, and an area ratio of magnetic domains of a width greater than 0.4 mm of 13–17%. The products were scanned with a laser beam.

The laser beam scanning was conducted under conditions of a scan line interval of 6.5 mm, exposure point interval of 0.5 mm, and radiation energy of 0.8 mJ/mm$^2$. The average deviation angle from {110}<001> orientation, $W_{17/50}$, $W_{19/50}$ and $W_{19/50}/W_{17/50}$ of the steel sheets are shown in Table 12. The invention examples can be seen to be superior in high magnetic field core loss property.

TABLE 12

| Final cold-rolling reduction ratio (%) | Deviation angle (degree) | $W_{17/50}$ (W/kg) | $W_{19/50}$ (W/kg) | $W_{19/50}/W_{17/50}$ | Remark |
|---|---|---|---|---|---|
| 81 | 8 | 0.90 | 1.74 | 1.93 | Comparative example |
| 83 | 6 | 0.88 | 1.68 | 1.91 | Comparative example |
| 85 | 4 | 0.79 | 1.42 | 1.80 | Invention example |

TABLE 12-continued

| Final cold-rolling reduction ratio (%) | Deviation angle (degree) | $W_{17/50}$ (W/kg) | $W_{19/50}$ (W/kg) | $W_{19/50}/W_{17/50}$ | Remark |
|---|---|---|---|---|---|
| 89 | 2 | 0.77 | 1.37 | 1.78 | Invention example |

Example 13

A high flux density grain-oriented electrical steel sheet product was produced by an ordinary method. The product composition included 0.002% of C, 3.26 of Si, 0.06% of Mn, 0.001% of S, 0.001% of Se, 0.07% of Sb and 0.07% of Mo. The product had a thickness of 0.23 mm and an average deviation angle from {110}<001> orientation of 5°. Portions thereof were subjected to etch-grooving of the intermediate-stage cold-rolled steel sheet under different conditions to alter the average 180° magnetic domain width.

The grooving was conducted under conditions of a groove interval of 3 mm, a groove width of 150 μm and a groove depth of 0–40 μm. The average 180° magnetic domain width, area ratio of magnetic domains of a width greater than 0.4 mm, $W_{17/50}$, $W_{19/50}$ and $W_{19/50}/W_{17/50}$ of the products are shown in Table 13. The invention examples can be seen to be superior in high magnetic field core loss property.

TABLE 13

| Groove depth (μm) | Average 180° magnetic domain width (mm) | Area ratio of magnetic domains greater than 0.4 mm (%) | $W_{17/50}$ (W/kg) | $W_{19/50}$ (W/kg) | $W_{19/50}/W_{17/50}$ | Remark |
|---|---|---|---|---|---|---|
| 0 | 0.33 | 26.2 | 0.79 | 1.56 | 1.97 | Comparative example |
| 30 | 0.28 | 15.8 | 0.73 | 1.35 | 1.85 | Invention example |

What is claimed is:

1. A high flux density grain-oriented electrical steel sheet excellent in high magnetic field core loss property ($W_{19/50}$) composed of, in percentage by weight, not greater than 0.005% of C, 2.0–7.0% of Si, not greater than 0.2% of Mn, one or both of S and Se in a total amount of not greater than 0.005%, and the balance of Fe and unavoidable impurities, the steel sheet having a grain orientation deviating from an ideal {110}<001> orientation by an average of not greater than 5° and having an average 180° magnetic domain width of not greater than 0.30 mm, wherein $W_{19/50}/W_{17/50}$ is less than 1.9.

2. A high flux density grain-oriented electrical steel sheet excellent in high magnetic field core loss property ($W_{19/50}$) composed of, in percentage by weight, not greater than 0.005% of C, 2.0–7.0% of Si, not greater than 0.2% of Mn, one or both of S and Se in a total amount of not greater than 0.005%, and the balance of Fe and unavoidable impurities, the steel sheet having a grain orientation deviating from an ideal {110}<001> orientation by an average of not greater than 5° and having an average 180° magnetic domain width of not greater than 0.26 mm, wherein $W_{19/50}/W_{17/50}$ is less than 1.85.

3. A high flux density grain-oriented electrical steel sheet excellent in high magnetic field core loss property ($W_{19/50}$) composed of, in percentage by weight, not greater than 0.005% of C, 2.0–7.0% of Si, not greater than 0.2% of Mn, one or both of S and Se in a total amount of not greater than 0.005%, and the balance of Fe and unavoidable impurities, the steel sheet having a grain orientation deviating from an ideal {110}<001> orientation by an average of not greater than 5° and having an average 180° magnetic domain width of not greater than 0.30 mm, wherein $W_{19/50}/W_{17/50}$ is less than 1.9, and wherein area ratio of magnetic domains of 180° width greater than 0.4 mm is greater than 3% and not greater than 20%.

4. A high flux density grain-oriented electrical steel sheet excellent in high magnetic field core loss property ($W_{19/50}$) composed of, in percentage by weight, not greater than 0.005% of C, 2.0–7.0% of Si, not greater than 0.2% of Mn, one or both of S and Se in a total amount of not greater than 0.005%, and the balance of Fe and unavoidable impurities, the steel sheet having a grain orientation deviating from an ideal {110}<001> orientation by an average of not greater than 5° and having an average 180° magnetic domain width of from 0.26 mm to 0.30 mm, wherein $W_{19/50}/W_{17/50}$ is less than 1.9, and wherein area ratio of magnetic domains of 180° width greater than 0.4 mm is greater than 3% and not greater than 20%.

5. A high flux density grain-oriented electrical steel sheet excellent in high magnetic field core loss property according to any of claims 1 to 4, further containing, in percentage by weight, nor greater than 0.065% of Al and not greater than 0.005% of N.

6. A high flux density grain-oriented electrical steel sheet excellent in high magnetic field core loss property according to any of claims 1 to 4, further containing, in percentage by weight, 0.003–0.3% each of one or more of Sb, Sn, Cu, Mo, Ge, B, Te, As, Cr and Bi.

* * * * *